US006557572B2

(12) United States Patent
Lah

(10) Patent No.: US 6,557,572 B2
(45) Date of Patent: May 6, 2003

(54) TENT POLE AND CONNECTING STRUCTURE THEREOF

(76) Inventor: Jeh-kun Lah, 542-3, Gajwa-dong, Suh-gu, Inchon (KR), 404-250

( * ) Notice: Subject to any disclaimer, the term of this patent is extended or adjusted under 35 U.S.C. 154(b) by 174 days.

(21) Appl. No.: 09/747,185

(22) Filed: Dec. 26, 2000

(65) Prior Publication Data

US 2003/0047203 A1 Mar. 13, 2003

(30) Foreign Application Priority Data

Dec. 27, 1999 (KR) ..... 99-29776

(51) Int. Cl.[7] ..... E04H 15/60; F16B 7/00

(52) U.S. Cl. ..... 135/114; 52/726.1; 52/726.3; 403/368

(58) Field of Search ..... 52/726.1, 726.2, 52/726.3; 135/114, 909; 403/365, 366, 367, 368; 43/18.1 CT, 18.1 HR; 285/334.1, 55

(56) References Cited

U.S. PATENT DOCUMENTS 1,846,305 A * 2/1932 Brooks
2,379,577 A * 7/1945 Harsted
2,984,853 A * 5/1961 Williams
3,447,549 A * 6/1969 Cunningham
3,567,257 A * 3/1971 Nowosadko
3,730,544 A * 5/1973 Hyman
4,441,273 A * 4/1984 McMickle et al.
4,819,969 A * 4/1989 Williams
6,382,223 B1 * 5/2002 Lah

FOREIGN PATENT DOCUMENTS

JP 6-257327 * 6/1994

* cited by examiner

*Primary Examiner*—Robert Canfield
(74) *Attorney, Agent, or Firm*—Nixon Peabody LLP; Jeffrey L. Costellia

(57) ABSTRACT

A tent pole and a connecting structure thereof include a shaft tube part of a prescribed length formed at an end portion of the tent pole, a stopper disposed outside a slanted part of the shaft tube part to restrict an inserted depth of the shaft tube part and a finishing member disposed at the end portion of the shaft tube part. The shaft tube part is inserted into the tent pole, and the finishing member performs a buffering action to the collision of the shaft tube part of the tent pole against the end portion of another tent pole to be connected with the shaft tube part when the tent poles are connected.

5 Claims, 9 Drawing Sheets

TENT POLE AND CONNECTING STRUCTURE THEREOF

BACKGROUND OF THE INVENTION

1. Field of the Invention

The present invention relates to a tent pole and a connecting structure thereof, and more particularly, to a tent pole and a connecting structure thereof, which can overcome weakness of connected portions between tent poles, which form a framework of a tent, and maintain a securely connected state of the tent pole.

2. Description of the Related Art

In general, a tent includes a waterproof cloth and a plurality of tent poles to make users stay temporarily during camping or spending the time outdoors. The plural tent poles are assembled to each other to form a prescribed shape and the waterproof cloth is covered thereon, and thereby the tent is perfected.

The tent poles are a framework for forming the inside space of the tent, and are manufactured in the form of a cylindrical pipe. As shown in FIG. 1, the inside space part of the tent pole 10 is provided with a rubber band or an elastic cord 20 with an excellent elasticity. Concretely, a tent pole 40 has a shaft tube part 41 formed at an end thereof. The shaft tube part 40 has the external diameter smaller than the internal diameter of other portions of the tent pole 40. Meanwhile, another tent pole 30 to be connected to the tent pole 40 has an enlarged tube part 32 formed at an end thereof to insert the shaft tube part 41 of the tent pole 40. The shaft tube part 41 of the tent pole 40 is inserted into the enlarge tube part 32 of the other tent pole 30, such that the tent poles 30 and 40 are connected to each other.

If the tent poles 30 and 40 are arranged in a line, the tent poles 30 and 40 are pulled from each other by the elasticity of the elastic cord 20, thereby connecting the tent poles 30 and 40 easily.

In the connecting structure of the tent poles, since the enlarged tube part 32 and the shaft tube part 41 are thinner than other portions of the tent poles 30 and 40, the tent poles 30 and 40 may be bent and damaged. FIG. 3 is a sectional view showing a connected state of the conventional tent poles. To reinforce the enlarged tube part 32 and the shaft tube part 41, as shown in FIG. 3, a reinforced rod 43 is arranged inside a slanted part 44 of the shaft tube part 41. The reinforced rod 43 has the external form corresponding to the internal shape of the slanted part 44. The reinforced rod 43 reinforces the slanted part 44 of the shaft tube part 41, thereby preventing the slanted part 44 of the shaft tube part 41 from being damaged when the tent poles are connected.

Meanwhile, the enlarged tube part 32 of the tent pole 30 to be connected to the tent pole 40 may have a stopper 33 being in the form of a ring to restrict the advance of the shaft tube part 41 of the tent pole 40 inserted into the enlarged tube part 32 of the tent pole 30.

However, in the connecting structure of the tent poles shown in FIG. 3, when the tent poles 30 and 40 arranged in a line are pulled from each other by the elasticity of the elastic cord 20, the shaft tube part 41 of the tent pole 40 and the enlarged tube part 32 of the tent pole 30 collide against each other. Generally, the tent pole is made of aluminum material and is thin, and thereby end portions of the tent poles may be damaged easily if colliding against each other.

SUMMARY OF THE INVENTION

It is, therefore, an object of the present invention to provide a tent pole and a connecting structure thereof, which can prevent the damage of the tent pole caused by collision of a shaft tube part and an end portion of the tent pole.

To achieve the above object, the present invention provides a tent pole comprising: a shaft tube part of a prescribed length formed at an end portion thereof, the shaft tube part being inserted into another tent pole; and a stopper provided at the outside of a slanted part of the shaft tube part to restrict an inserted depth of the shaft tube part.

It is preferable that the stopper is in the form of a ring, which has a hole formed at the center.

Furthermore, the end portion of the shaft tube part has a finishing member performing a buffering action to the collision against an end portion of the other tent pole to be connected to the shaft tube part when the tent poles are connected.

It is preferable that the finishing member includes an external surface having a streamlined convex portion, an insertion part inserted into the shaft tube part of the tent pole and a through hole formed at the center to pass an elastic cord passing through the inside of the tent pole.

The shaft tube part of the tent pole may have a reinforced rod mounted inside the slanted part to reinforce the slanted part, the reinforced rod having the external form corresponding to the internal form of the slanted part.

The reinforced rod includes a round part being in the form of a ring, which has the external diameter corresponding to the internal diameter of the shaft tube part, and a conical portion having a slanted surface, the conical portion having the external diameter corresponding to the slanted internal diameter of the slanted part.

Moreover, the present invention provides a connecting structure of tent poles, in which a stopper is mounted outside a slanted part of a shaft tube part, which is formed at an end portion of the tent pole in a prescribed length, to restrict the inserted depth of the shaft tube part, and the shaft tube part is inserted into an end portion of another tent pole to connect the tent poles with each other.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
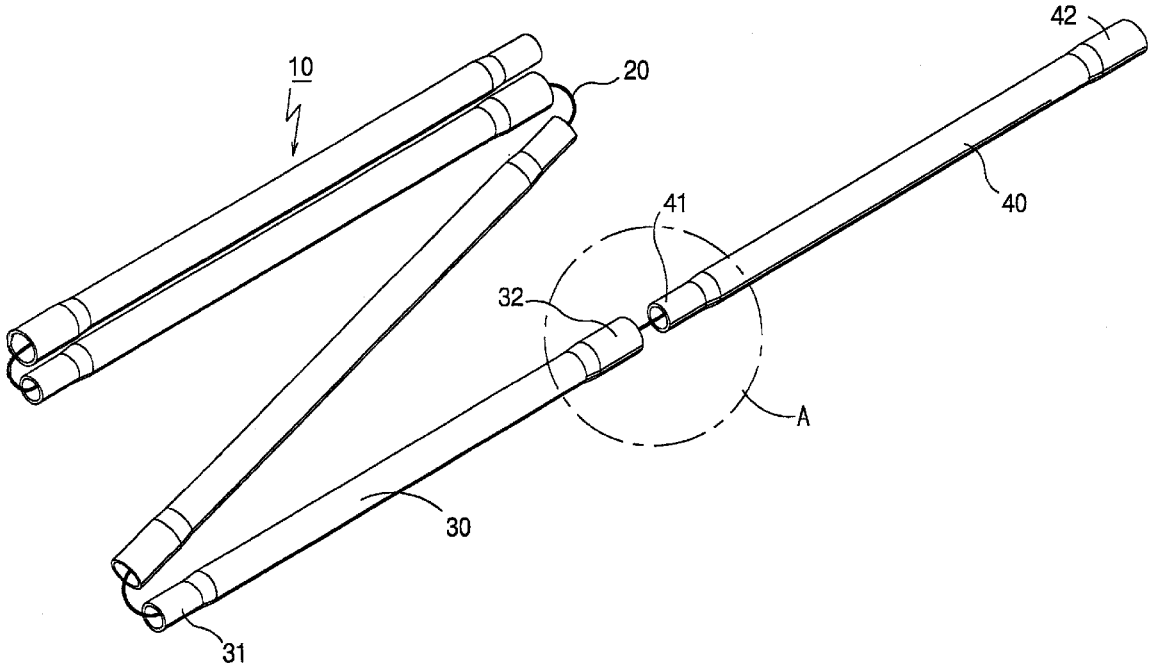
Fig.1 Prior Art
FIG. 1 is a perspective view of conventional tent poles.
Figure 2:
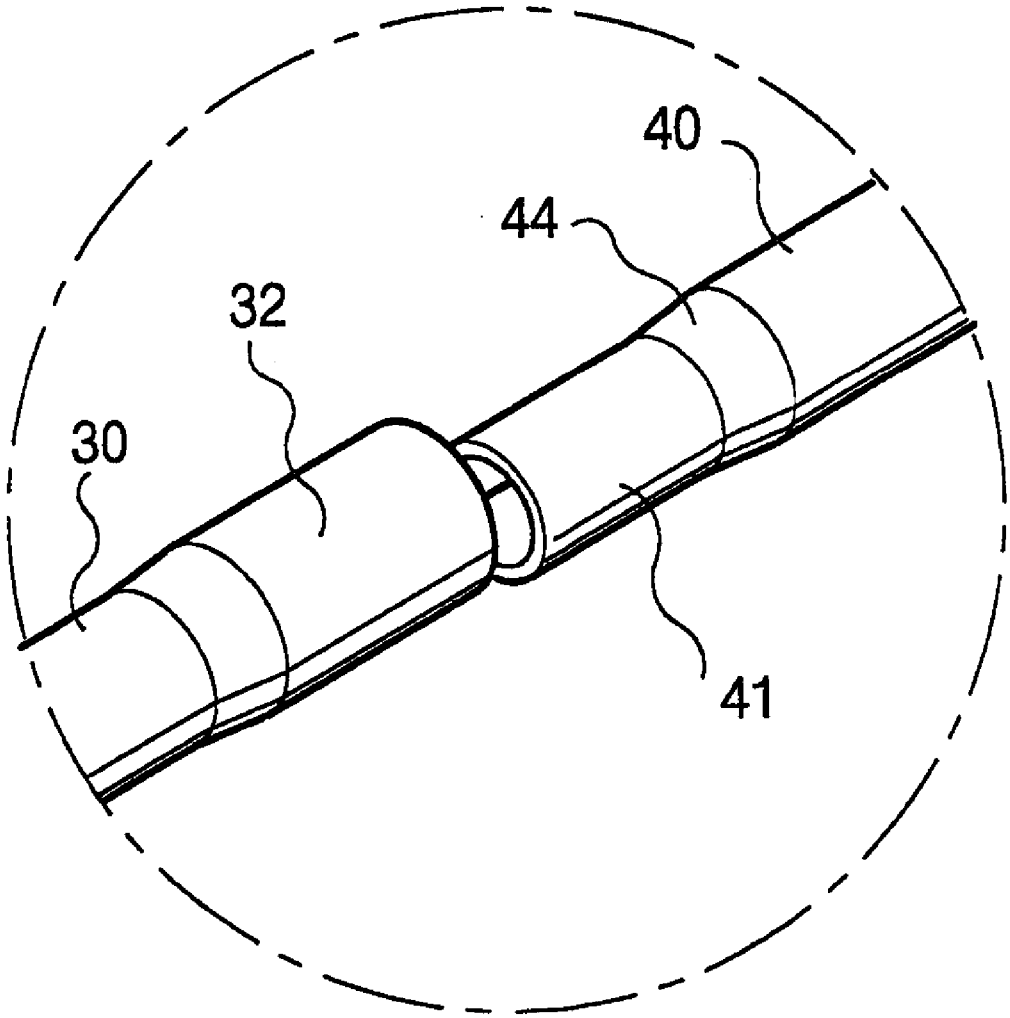
Fig.2 Prior Art
FIG. 2 is an enlarged view of a portion "A" of FIG. 1.
Figure 3:
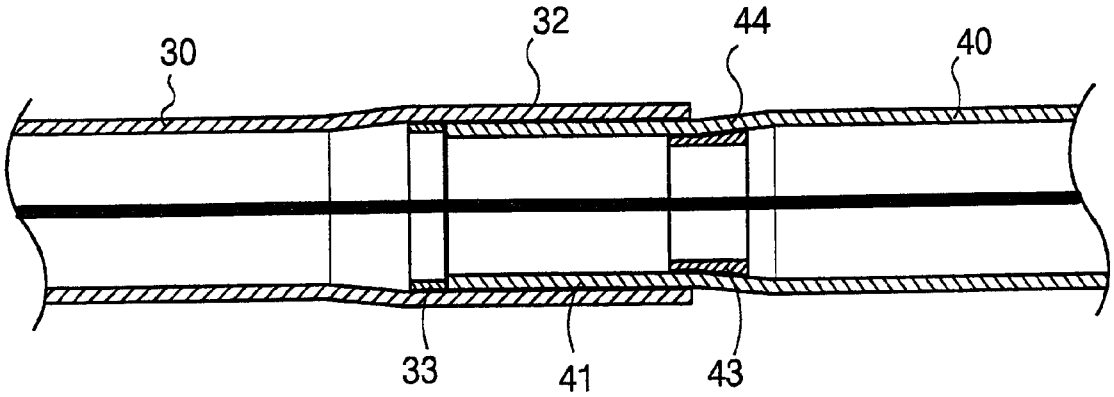
Fig.3 Prior Art
FIG. 3 is a sectional view showing a connected state of the conventional tent poles.

The present invention will now be described in detail in connection with preferred embodiments with reference to the accompanying drawings. For reference, like reference characters designate corresponding parts throughout several views.

Figure 4:
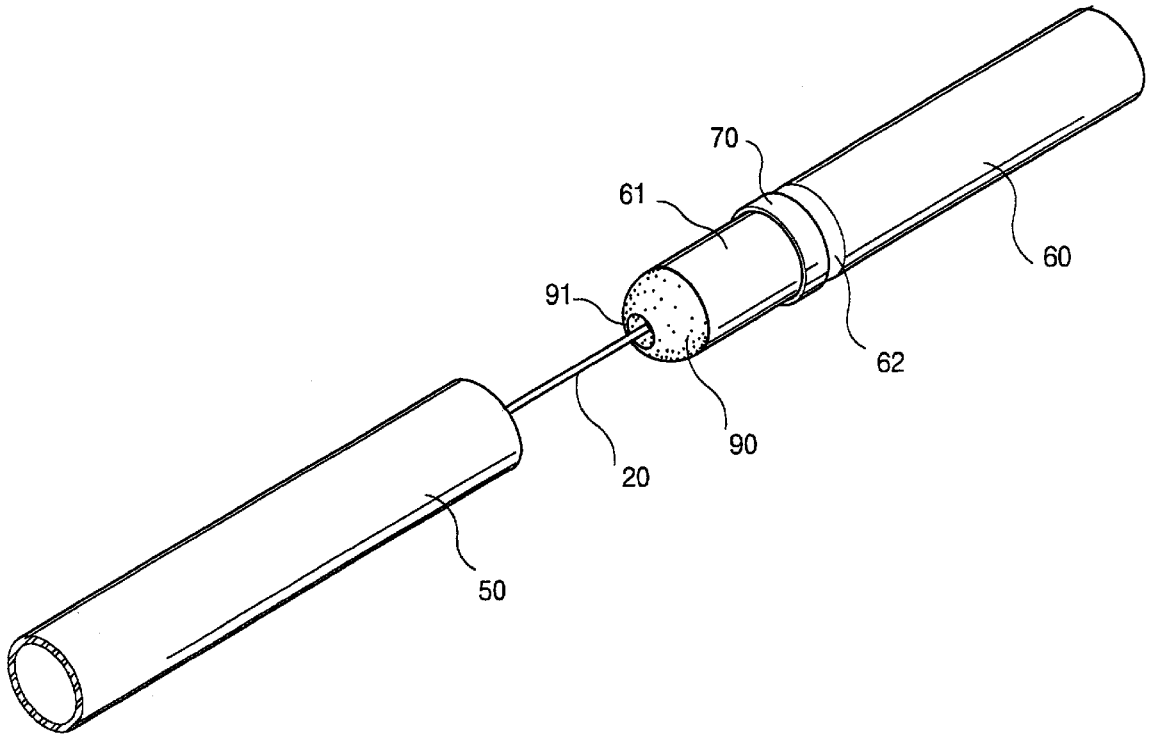
FIG. 4 is a perspective view of tent poles according to a preferred embodiment of the present invention.
Figure 5:
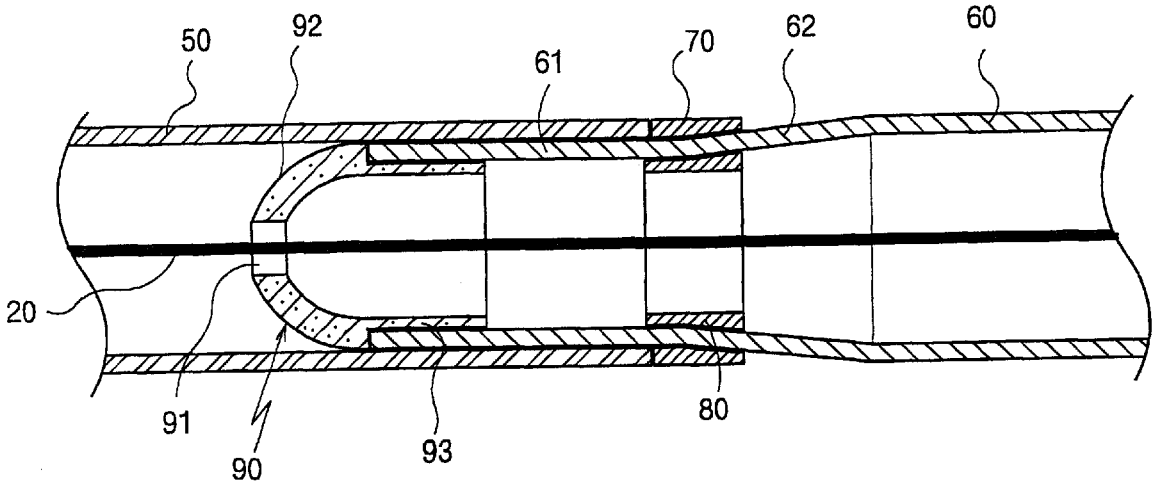
FIG. 5 is a sectional view showing a connected state of the tent poles of FIG. 4.

FIG. 4 is a perspective view of a connected part of tent poles according to a preferred embodiment of the present invention, and FIG. 5 is a sectional view of the connected tent poles. As shown in the drawings, a tent pole 60 has a shaft tube part 61 of a prescribed length provided at an end portion of the tent pole 60. The shaft tube part 61 has the external diameter smaller than that of other portions of the tent pole 60. In the drawing, another tent pole 50 to be connected to the tent pole 60 does not have an enlarged tube part at an end, but the enlarged tube part, which has the internal diameter larger than the external diameter of the shaft tube part 61 of the tent pole 60, may be formed at the end portion of the tent pole 50.

Figure 8A:
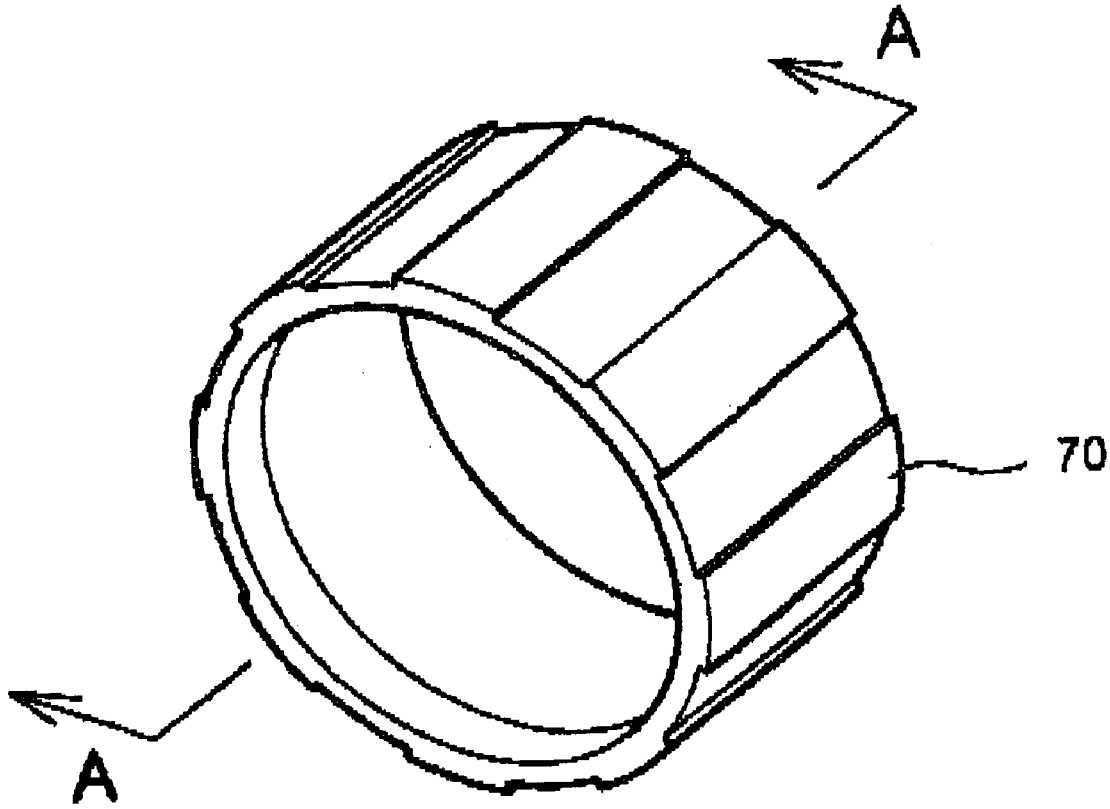
FIG. 8*a* is a perspective view of an embodiment of a stopper.
Figure 8B:
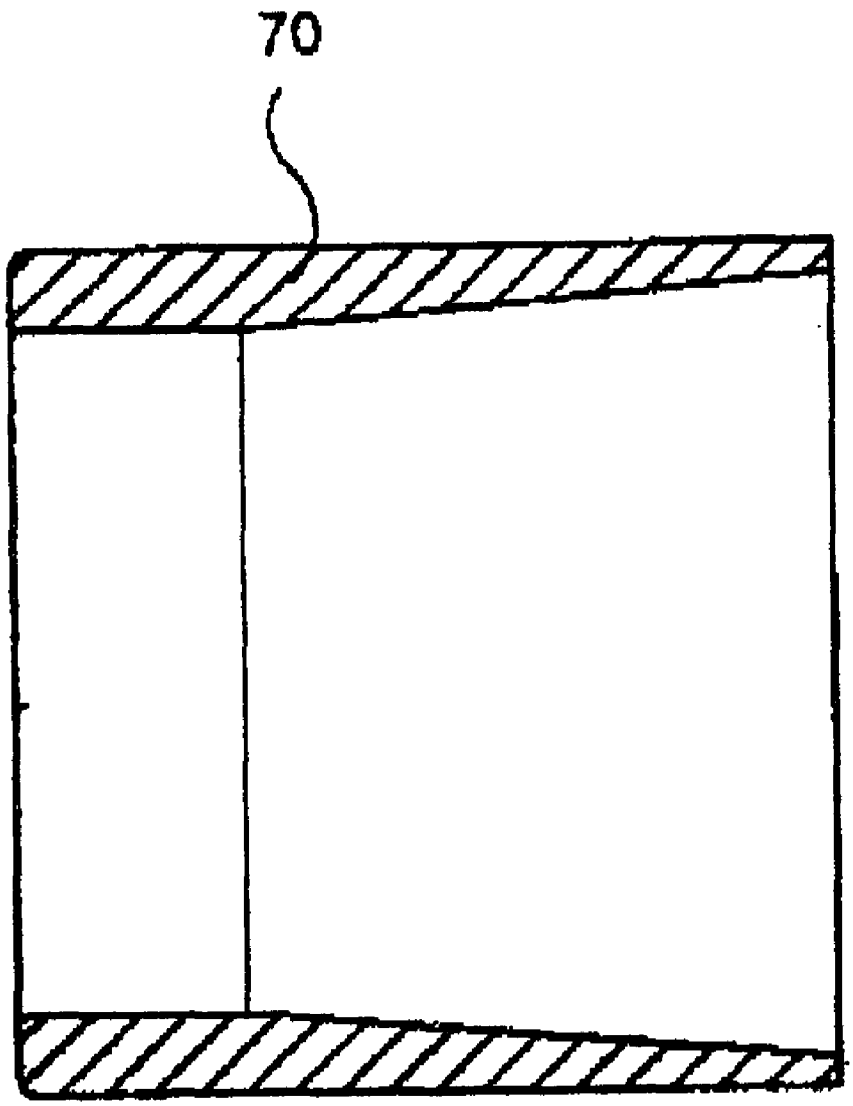
FIG. 8*b* is a cross sectional view of FIG. 8*a* in accordance with line A—A.

In the present invention, a stopper 70 being in the form of a ring is mounted outside the shaft tube part 61 of the tent pole 60. When the shaft tube part 61 is inserted into the end portion of the tent pole 50, the end portion of the tent pole 50 can be inserted into a slanted part 62 of the shaft tube part 61. If the end portion of the tent pole 50 is tightly fit into the slanted part 62 of the shaft tube part 61, the outside of the slanted part 62 may be damaged and it may be difficult to separate the connected tent poles 50 and 60 from each other. In the present invention, when the shaft tube part 61 is inserted into the end portion of the tent pole 50 beyond a prescribed limit, as the end portion of the tent pole 50 is contacted with the stopper 70, the shaft tube part 61 is not inserted into the inside the tent pole 50 beyond the prescribed limit. Therefore, the end portion of the tent pole 50 does not tightly fit into the slanted part 62 of the shaft tube part 61, such that the tent poles 50 and 60 can be easily separated from each other. The internal shape of the stopper 70 corresponds to the outer shape of the shaft tube part 61 and the slanted part 62. FIG. 8*a* shows an embodiment of the stopper 70, and FIG. 8*b* shows a cross section thereof.

Figure 6:
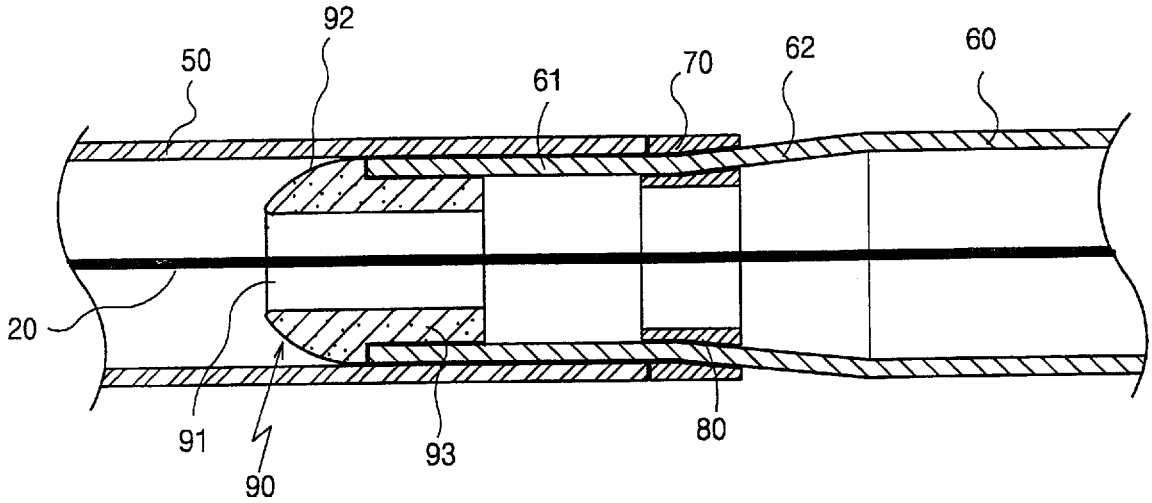
FIG. 6 is a sectional view showing a connected state of tent poles according to another preferred embodiment of the present invention.
Figure 7:
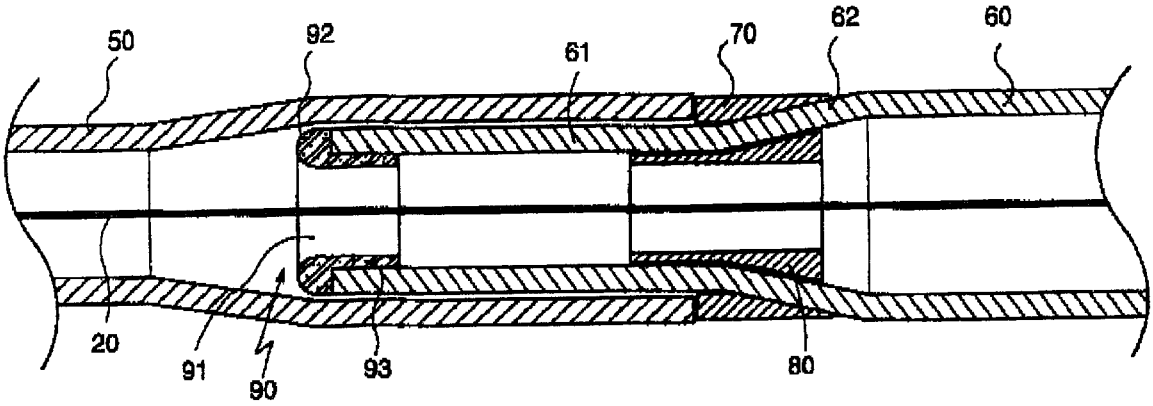
FIG. 7 is a sectional view showing a connected state of tent poles according to another preferred embodiment of the present invention.

The tent pole 60 according to the present invention is provided with a finishing member 90 at the end portion of the shaft tube part 61. As shown in FIG. 5, the finishing member 90 includes an external surface 92 having a streamlined convex portion and an insertion part 93 inserted into the shaft tube part 61 of the tent pole 60. The finishing member 90 further includes a through bole 91 formed at the center, and an elastic cord 20, which passes through the inside of the tent poles 50 and 60, passes the through hole 91. The finishing member 90 is not restricted in material, but it is preferable to be made of ductile material. FIG. 6 is a sectional view showing a connected state of the tent poles 50 and 60 having the finishing member 90, which is in a different form. FIG. 7 is a sectional view showing a connected state of the tent poles 50 and 60 having the finishing member 90, which is in a different form. In the embodiment disclosed in FIG. 7, the tent pole 50 to be connected to the tent pole 60 has an enlarged tube part at the end portion of the tent pole 50, which has the internal diameter larger than the external diameter of the shaft tube part 61 of the tent pole 60.

Since the elastic cord 20 passes through the inside of the tent poles 50 and 60, if arranged in a line, the tent poles 50 and 60 are pulled from each other by the elasticity of the elastic cord 20. However, when the tent poles 50 and 60 are pulled from each other, the end portions of the tent poles 50 and 60 may collide against each other. The finishing member 90 provided in the end portion of the shaft tube part 61 of the tent pole 60 performs a buffering action when the end portions of the tent poles 50 and 60 collide against each other, thereby preventing the end portions of the tent poles 50 and 60 from being damaged by colliding against each other.

Moreover, since the external surface 92 of the finishing member 90 is in the form of a convex curve, if colliding against the external surface 92 of the finishing member 90, the of the shaft tube part, and a conical portion having a slanted surface. The conical portion has the external diameter corresponding to the slanted internal diameter of the slanted part. The reinforced rod 80 is inserted into the tent pole 60 and located at the slanted part 62 of the shaft tube part 61.

The tent poles 50 and 60 according to the present invention are connected with each other by the following structure. First, the stopper 70 is mounted outside the shaft tube part 61 of the tent pole 60. The reinforced rod 80 is inserted and fixed into the shaft tube part 61. The finishing member 90 is arranged at the end portion of the shaft tube part 61 of the tent pole 60.

If arranged in a line, the tent poles 50 and 60 are pulled from each other by the elasticity of the elastic cord 20. When contacted with the finishing member 90, the end portion of the tent pole 50 is moved along the streamlined external surface 92 of the finishing member 90, and thereby the shaft tube part 61 of the tent pole 60 is inserted into the end portion of the tent pole 50 smoothly. When the shaft tube part 61 is inserted into the prescribed limit and the end portion of the tent pole 50 is contacted with the stopper 70, the movement of the tent pole 50 is stopped, and thereby the connection between the tent pole 50 and 60 is finished.

As previously described, according to the present invention, when the end portions of the tent poles 50 and 60 collide against each other, the finishing member 90 provided in the end portion of the shaft tube part 61 of the tent pole 60 performs the buffering action. Therefore, the end portions of the tent poles 50 and 60 are prevented from being damaged by directly colliding against each other.

Moreover, since the external surface 92 of the finishing member 90 is in the form of the convex curve, if colliding against the external surface 92 of the finishing member 90, the end portion of the tent pole 50 is moved along the curve of the external surface 92, and thereby the shaft tube part 61 of the tent pole 60 is inserted into the end portion of the tent pole 50 smoothly. Therefore, there is no noise caused by colliding against the end portions when the tent poles 50 and 60 are connected.

Furthermore, the reinforced rod 80 is mounted in the slanted part 62 of the shaft tube part 61 of the tent pole 60 to reinforce the slanted part 62. Therefore, even though stress is concentrated on the slanted part 62 by the external force, the slanted part 62 is protected from the damage by the reinforcing action of the reinforced rod 80. Therefore, it is guaranteed to connect the tent poles 50 and 60 securely.

Additionally, since the intensity of the slanted part 62 is increased by the reinforcing action of the reinforced rod 80, the length of the shaft tube part 61 inserted into the end portion of tent pole is reduced, and thereby the weight of the tent pole can be reduced.

Especially, the stopper 70 mounted outside the shaft tube part 61 restricts the inserted depth of the shaft tube part 62, and thereby it is prevented that the end portion of the tent pole 50 is inserted into the slanted part 62 of the shaft tube part 61. Therefore, the connected tent poles can be easily separated from each other and the slanted part 62 is prevented from being damaged.

While the present invention has been described with reference to the tent poles, it is not to be restricted by the tent poles but can be applied to sticks or others. It is to be appreciated that those skilled in the art can change or modify the embodiments without departing from the scope and spirit of the present invention.

What is claimed is:

1. A connecting structure of tent poles, wherein a stopper is mounted outside a slanted part of a shaft tube part, which is formed at an end portion of the tent pole in a prescribed length, to restrict the inserted depth of the shaft part, and the shaft tube part is inserted into an end portion of another tent pole to connect the tent poles with each other, and wherein the end portion of the shaft tube part has a finishing member performing a buffering action to the collision against the end portion of the tent pole to be connected with the shaft tube when the tent poles are connected.

2. A tent pole comprising:

a shaft tube part of a prescribed length formed at an end portion thereof, the shaft tube part being inserted into another tent pole; and a stopper provided at the outside of a slanted part of the shaft tube part to restrict an inserted depth of the shaft tube part, wherein the end portion of the shaft tube part has a finishing member performing a buffering action to the collision against an end portion of the other tent pole to be connected to the shaft tube part when the tent poles are connected.

3. The tent pole as claimed in claim 2, wherein the finishing member includes an external surface having a streamlined convex portion, an insertion part inserted into the shaft tube part of the tent pole and a through hole formed at the center, the through hole through which an elastic cord, which passes the inside of the tent pole, passes.

4. The tent pole as claimed in claim 2 or 3, wherein the shaft tube part of the tent pole has a reinforced rod mounted inside the slanted part to reinforce the slanted part, the reinforced rod having the external form corresponding to the internal form of the slanted part.

5. The tent pole as claimed in claim 4, wherein the reinforced rod includes a round part being in the form of a ring, which has the external diameter corresponding to the internal diameter of the shaft tube part, and a conical portion having a slanted surface, the conical portion having the external diameter corresponding to the slanted internal diameter of the slanted part.

* * * * *